US007078087B2

(12) United States Patent
Romano, III et al.

(10) Patent No.: US 7,078,087 B2
(45) Date of Patent: Jul. 18, 2006

(54) WIPES WITH AN EDGE TREATMENT ALONG A LEADING EDGE PORTION

(75) Inventors: Lawrence James Romano, III, Appleton, WI (US); Kenneth Bradley Close, New London, WI (US); Larry Edgerton Brown, Appleton, WI (US); Steven R. Kalmanson, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 274 days.

(21) Appl. No.: 10/749,864

(22) Filed: Dec. 31, 2003

(65) Prior Publication Data

US 2005/0142336 A1 Jun. 30, 2005

(51) Int. Cl.
*B32B 3/26* (2006.01)

(52) U.S. Cl. ..... 428/126; 428/124; 428/153; 428/177; 428/192; 221/48

(58) Field of Classification Search ..... 428/124, 428/126, 153, 177, 192; 221/48; 206/494
See application file for complete search history.

(56) References Cited

U.S. PATENT DOCUMENTS

| | | | | |
|---|---|---|---|---|
| 711,840 | A * | 10/1902 | Fernald | 428/84 |
| 2,502,772 | A | 4/1950 | Winstead | |
| 3,894,898 | A | 7/1975 | Taylor | |
| 4,100,324 | A | 7/1978 | Anderson et al. | |
| 4,450,026 | A | 5/1984 | Pieniak et al. | |
| 4,475,881 | A | 10/1984 | Borst et al. | |
| 4,720,415 | A | 1/1988 | Vander Wielen et al. | |
| 4,741,944 | A | 5/1988 | Jackson et al. | |
| 4,778,048 | A | 10/1988 | Kaspar et al. | |
| 5,368,188 | A | 11/1994 | Twardowski | |
| 5,385,775 | A | 1/1995 | Wright | |
| 5,508,102 | A | 4/1996 | Georger et al. | |
| 5,540,332 | A | 7/1996 | Kopacz et al. | |
| 5,642,835 | A | 7/1997 | Young et al. | |
| 5,891,008 | A | 4/1999 | Bavely et al. | |
| 6,848,595 | B1 * | 2/2005 | Lange et al. | 221/48 |

FOREIGN PATENT DOCUMENTS

| | | |
|---|---|---|
| WO | WO 2002/053365 A2 | 7/2002 |
| WO | WO 2002/053368 A2 | 7/2002 |
| WO | WO 2002/076723 A1 | 10/2002 |
| WO | WO 2003/097933 A1 | 11/2003 |
| WO | WO 2004/054916 A1 | 7/2004 |

* cited by examiner

*Primary Examiner*—Alexander S. Thomas
(74) *Attorney, Agent, or Firm*—Michael J. Bendel; Scott A. Baum

(57) ABSTRACT

The invention provides a wipe. The wipes include at least one non-woven web. The web includes an edge portion adjoining a main portion. The web has a top surface and a spaced apart opposite bottom surface and is defined by a width of the web which is perpendicular to a length of the web. The top surface of the main portion defines a top plane and the bottom surface of the main portion defines a bottom plane. The top and bottom planes are parallel to one another and a z-directional dimension of the web extends through the top and bottom planes and is orthogonal to the top and bottom planes. The edge portion includes and edge treatment wherein the edge treatment comprises at least a portion of the edge portion being permanently deformed in a non-random pattern in the z-directional dimension.

27 Claims, 9 Drawing Sheets

WIPES WITH AN EDGE TREATMENT ALONG A LEADING EDGE PORTION

BACKGROUND OF THE INVENTION

Wipes have been made from a variety of materials which may be dry or wet when used. Perhaps the most common form of wipes has been a stack of moistened sheets which have been packaged in a plastic container and are know as wet wipes. Typically, the wipes have had linear (e.g., straight) or non-linear (e.g., curved or zigzagged) edges and a generally rectangular configuration. The wipes have also been available in either folded or unfolded configurations. For example, stacks of wipes have been available wherein each of the wipes in the stack have been arranged in a folded configuration such as a c-folded, z-folded, quarter-folded or other zigzag folded configurations, as are well known to those skilled in the art. Each folded wipe could have been interfolded with the wipes immediately above and below in the stack of wipes. Alternatively, wipes have been formed as discrete wipes that are separate from one another upon formation into a stack of wipes and that are intended to not interact with one another upon dispensing. Still alternatively, wipes have been in the form of continuous webs of material which include perforations to separate the individual wipes and which are wound into rolls or formed into zigzag shaped stacks and then packaged in plastic containers. Such wipes have been used for baby wipes, hand wipes, household cleaning wipes, industrial wipes and the like. The wet wipes have been made from a variety of materials and are moistened with a suitable wiping solution.

The conventional packages which contain stacks of wipes, such as those described above, have been designed to provide one at a time dispensing which may be accomplished using a single hand. Such single handed, one at a time dispensing is particularly desirable because the other hand of the user is typically required to be simultaneously used for other functions. For example, when changing a diaper product on an infant, the user typically uses one hand to hold and maintain the infant in a desired position while the other hand is searching for a wet wipe, such as a baby wipe, to clean the infant.

However, the dispensing of wipes in such stacks has not been completely satisfactory. For example, users of the wipes have had difficulties recognizing and grasping the leading edge of each individual wipe to dispense or remove the wet wipe from the package. This problem has been particularly acute when the individual wipes in the stack are folded such that the leading edge of each wipe is folded over upon another portion of the same wipe, e.g., in a c-folded, z-folded or other zigzag folded configurations. Typically, the user will frictionally drag from one to three fingers across the top surface of the stack of wet wipes in an attempt to locate the leading end edge of the top wipe from the stack of wipes. However, the leading edge of each wipe in such a folded configuration has tended to have an affinity for the other portions of the wipe, especially when the wipes have been arranged in a stacked configuration for a period of time, and/or when the wipes are wet wipes due to adhesion caused by the moistening solution. As a result, in use, it has been undesirably difficult for the user to locate the leading edge of each wipe from the other portions of the wipe to facilitate the dispensing of each wipe from the stack of wet wipes.

Moreover, as each wipe in the stack of wipes has been dispensed or removed from the stack, the trailing edge portion of the wipe has not always easy to locate in case such is needed to separate the adjacent middle portion of the wipe from the trailing end. Such difficult location has undesirably caused the user to expend extra efforts searching for the edge to unfold the wipe to gain full access to its surface area for wiping. Such difficult location has undesirably resulted in reduced consumer acceptance.

The difficulties encountered in dispensing the existing wipes have been particularly evident in stacks of wipes which have a solution add-on (i.e., wet wipes, and particularly wipes with greater solution add-on) and in stacks of wipes which have a greater number of wipes. For example, each wet wipe and, in particular, the leading and trailing edges of each wet wipe, has had an increased affinity for the other portions of the same wet wipe as the amount of solution in the stack increases. As a result, the consistency and reliability of the dispensing of such wet wipes has undesirably declined as the amount of solution has increased. Accordingly, it is desired to provide a wipe and stack of wipes, each in a reach-in format, which have enhanced dispensability, particularly for wet wipes.

SUMMARY OF THE INVENTION

In response to the difficulties and problems discussed above, for example, a new feature for wipes in a stack of discrete wipes, and which may be cost effective and more reliable (e.g., reducing the likelihood of difficult wipe edge location during dispensing), has been developed. For example, dispensing may be enhanced or made easier when a top wipe is ready for dispensing upon the opening of a resealable wipes dispenser, by one or more of a visual and/or tactile cue. That is, a leading edge of the top wipe may be more consistently readily locatable relative to the stack of wipes so a user may readily find and grasp the edge and remove the entire individual wipe. As another example, dispensing may be enhanced or made easier when a folded wipe trailing edge is readily locatable so the entire wipe may be easily extended to full length by the user if desired. The purposes and features of the present invention will be set forth in and are apparent from the description that follows, as well as will be learned by practice of the invention. Additional features of the invention will be realized and attained by the product, process and system particularly pointed out in the written description and claims hereof, as well as from the appended drawings.

In one aspect, the invention provides a wipe. The wipe includes at least one non-woven web. The web includes an edge portion adjoining a main portion. The web has a top surface and a spaced apart opposite bottom surface and is defined by a width of the web which is perpendicular to a length of the web. The top surface of the main portion defines a top plane and the bottom surface of the main portion defines a bottom plane. The top and bottom planes are parallel to one another and a z-directional dimension of the web extends through the top and bottom planes and is orthogonal to the top and bottom planes. The edge portion includes an edge treatment wherein the edge treatment comprises at least a portion of the edge portion being permanently deformed in a non-random pattern in the z-directional dimension such that the top surface of the edge portion defines a top edge plane and the bottom surface of the edge portion defines a bottom edge plane, and at least one of the top edge plane and the bottom edge plane is outside of a bounded region defined between the top and bottom planes of the main portion.

In another aspect, the invention provides a wipe. The wipe includes at least one non-woven web. The web includes an edge portion adjoining a main portion. The web has a top surface and a spaced apart opposite bottom surface and is defined by a width of the web which is perpendicular to a length of the web. The top surface of the main portion defines a top plane and the bottom surface of the main portion defines a bottom plane. The top and bottom planes are parallel to one another and a z-directional dimension of the web extends through the top and bottom planes and is orthogonal to the top and bottom planes. The edge portion includes an edge treatment wherein the edge treatment comprises at least a portion of the edge portion being permanently deformed in a non-random pattern in the z-directional dimension whereby the edge portion has an Edge Resilient Value and the main portion has a Main Resilient Value such that the Edge Resilient Value is greater than the Main Resilient Value.

In still another aspect, the invention provides a wipe. The wipe includes at least one non-woven web. The web includes an edge portion adjoining a main portion. The web has a top surface and a spaced apart opposite bottom surface and is defined by a width of the web which is perpendicular to a length of the web. The top surface of the main portion defines a top plane and the bottom surface of the main portion defines a bottom plane. The top and bottom planes are parallel to one another and a z-directional dimension of the web extends through the top and bottom planes and is orthogonal to the top and bottom planes. The edge portion includes an edge treatment wherein the edge treatment comprises at least a portion of the edge portion being permanently deformed in a non-random pattern in the z-directional dimension whereby the edge portion has an Edge Length Value and the main portion has a Main Length Value such that the Edge Length Value is greater than the Main Length Value. The Length Value may be determined from either the MD or CD of the wipe.

In yet another aspect, the invention includes a process for forming the wipes. The process includes, and advantageously in the following order: providing a supply of a common material; forming a plurality of panels, each panel adjacent to at least one other panel; creating the edge treatment located along at least one side of each panel; converting the plurality of panels into a plurality of wipes, each wipe of the plurality of wipes including a leading edge portion with the edge treatment located along at least a portion of the leading edge portion and the edge treatment being distinct from an adjoining main portion of each wipe; and positioning each wipe relative to adjacent wipes to form the stack of wipes.

In yet other aspects, the invention provides various configurations for the process and system for making wipes, for wipes per se, and for the wipes relative to other wipes such as in a stack of wipes.

In still other aspects, the invention provides wipes for use in various types of dispensers, e.g., rigid to non-rigid, and for dispensing in various manners such as reach-in dispensing with wet or dry wipes.

Various definitions used throughout the specification are provided first, followed by a further description of aspects of the invention.

DEFINITIONS

As used herein, "reach-in" dispensing is understood to mean having to fetch a wipe out of a dispenser through an opening substantially co-extensive with the walls of the dispenser or through a restricted opening smaller than the perimeter defined by the walls. In either case, the top wipe for dispensing rests on top of the remainder of the stack of wipes and the top wipe needs to be separated from the remainder of the stack each time anew when dispensing is desired. An example of a reach-in dispenser is found in the currently available baby wipes product sold by Kimberly-Clark Corporation of Neenah, Wis. under the trade name HUGGIES® Supreme Care.

As used herein, when the following wipe has at least a portion through the opening of the dispenser or package and is intentionally maintained in the opening after the leading wipe is completely separated from the following wipe, this is referred to as "pop-up" format or dispensing. To be intentionally maintained in the opening means the opening is configured to maintain the wipe in the opening between successive dispensing occasions, such as through use of a constricting orifice or opening being smaller than the wipe in at least one dimension of the wipe.

As used herein, "permanent," "permanently deforming," "permanently deformed," and "permanently deform" and like word variations, mean that a wipe when formed with an edge treatment will maintain at least 10% of the z-directional dimension thickness imparted to the edge portion by the edge treatment upon formation of the same even after the wipe is wet with a wetting solution and formed into a stack of wipes. To determine if a wipe meets the requirements set forth by this definition a just formed wipe with an edge treatment is obtained before the wipe is wet with a wetting solution (e.g. distilled water) and the Thickness of the edge portion with the edge treatment is measured using the Thickness measurement method herein. The wipe is then formed into a stack of wipes with other similarly edge treated wipes and the stack is moistened to whatever commercially desired level will be used for commercial sale with commercial wetting solution (which may be no moisture to complete saturation) and the formed stack of product is kept at TAPPI standard test conditions in its commercial dispenser as it would be on store shelf, for one week (hereafter the "commercial-like wipes"). At the end of one week, a sufficient number of wipes from the stack are removed and unfolded (if folded in the dispenser) and laid flat. Then, the Thickness of the edge treatment of the commercial-like wipes is measured using the Thickness measurement method herein. If the Thickness of the edge treatment of the commercial-like wipes is at least 10% the value of the Thickness of the edge treatment of the wipes after their formation but before they become commercial-like wipes, then the wipes are "permanently deformed" within the teaching of the invention. If the Thickness of the edge treatment of the commercial-like wipes is less than 10% the value of the Thickness of the edge treatment of the wipes before they become commercial-like wipes, then the wipes are not "permanently deformed" within the meaning of the invention.

As used herein, the term "discrete" means wipes are separate from one another upon formation into a plurality of wipes, such as a stack of wipes, and which wipes are intended to not interact with one another upon dispensing (other than that which may occur intermittently due to adhesion which may exist between wipes because their adjacent surfaces are positioned against one another, and particularly when the wipes are wet wipes). For example, each wipe in the plurality is not designed to intentionally and near consistently throughout the plurality of wipes draw up any portion of the succeeding wipe.

As used herein, the term "wet wipe" refers to a fibrous sheet that has a liquid applied thereto during manufacture. The amount of liquid or solution contained within each wet wipe may vary depending upon the type of material being used to provide the wet wipe, the type of liquid being used, the type of container being used to store the stack of wet wipes, and the desired end use of the wet wipe. Generally, each wet wipe may contain from about 25 to about 700 weight percent or from about 200 to about 400 weight percent liquid based on the dry weight of the wipe, for improved wiping in certain situations. To determine the liquid add-on, first the weight of a just-manufactured dry wipe is determined. Then, the amount of liquid by weight equal to the weight of the just-manufactured dry wipe, or an increased amount of liquid measured as a percent add-on based on the weight of the just-manufactured dry wipe, is added to the wipe to make it moistened, and then known as a "wet wipe" or "wet wipes". The liquid may include a fragrance and/or an emollient and may serve to aid the fibrous sheet in retention of materials, which are to be wiped up during its utilization.

As used herein, the term "nonwoven web" means a structure or a web of material that has been formed without use of traditional fabric forming processes such as weaving or knitting, to produce a structure of individual fibers or threads that are intermeshed, but not in an identifiable, repeating manner. Non-woven webs have been, in the past, formed by a variety of conventional processes such as, for example, meltblowing processes, spunbonding processes, film aperturing processes, staple fiber carding processes, and air laid and wet laid processes.

As used herein, the term "coform" means a non-woven composite material of air-formed matrix material comprising thermoplastic polymeric meltblown fibers such as, for example, microfibers having an average fiber diameter of less than about 10 microns, and a multiplicity of individualized absorbent fibers such as, for example, wood pulp fibers disposed throughout the matrix of polymer microfibers and engaging at least some of the microfibers to space the microfibers apart from each other. The absorbent fibers are interconnected by and held captive within the matrix of microfibers by mechanical entanglement of the microfibers with the absorbent fibers, the mechanical entanglement and interconnection of the microfibers and absorbent fibers alone form a coherent integrated fibrous structure. The coherent integrated fibrous structure may be formed by the microfibers and wood pulp fibers without any adhesive, molecular or hydrogen bonds between the two different types of fibers. The absorbent fibers are preferably distributed uniformly throughout the matrix of microfibers to provide a homogeneous material. These materials are prepared according to the descriptions in U.S. Pat. No. 4,100,324 to Anderson et al. ("Anderson"), U.S. Pat. No. 5,508,102 to Georger et al. ("Georger") and U.S. Pat. No. 5,385,775 to Wright ("Wright"), as well as related teaching in U.S. Pat. No. 6,946,413, entitled "Composite Material With Cloth-Like Feel", filed Dec. 29, 2000 (also known as WO 02/053365 published Jul. 11, 2002) and U.S. Pat. No. 6,811,638, entitled "Method And Apparatus For Controlling Retraction Of Composite Materials", filed Dec. 28, 2001 (also known as WO 02/053368 published Jul. 11, 2002), all assigned to the same Assignee as in the present invention.

The term "elastic" as used herein, means any material which, upon application of a biasing force, is stretchable, that is, elongatable at least about 5 percent (i.e., to a stretched, biased length which is at least about 105 percent of its relaxed unbiased length), and which, may recover at least 5 percent of its elongation upon release of the stretching, elongating force. A hypothetical example would be a one (1) cm sample of a material which is elongatable to at least 1.05 cm and which, upon being elongated to 1.05 cm and released, may recover to a length of not more than 1.0475 cm. Many elastic materials may be elongated by much more than 5 percent (i.e., much more than 105 percent of their relaxed length), for example, elongated 100 percent or more, and many of these may recover to substantially their initial relaxed length, for example, to within 105 percent of their original relaxed length, upon release of the stretching force.

As used herein, the term "non-elastic" refers to any material which does not fall within the definition of "elastic," above.

The terms "recover" and "recovery" as used herein refer to a contraction of a stretched material upon termination of a biasing force following stretching of the material by application of the biasing force. For example, if a material having a relaxed, unbiased length of one (1) cm is elongated 50 percent by stretching to a length of one and one half (1.5) cm the material would be elongated 50 percent (0.5 cm) and would have a stretched length that is 150 percent of its relaxed length. If this exemplary stretched material contracted, that is recovered to a length of one and one tenth (1.1) cm after release of the biasing and stretching force, the material would have recovered 80 percent (0.4 cm) of its one-half (0.5) cm elongation. Recovery may be expressed as [(maximum stretch length−final sample length)/(maximum stretch length−initial sample length)] times 100.

As used herein, the term "machine direction (MD)" refers to the direction of travel of the forming surface onto which fibers are deposited during formation of a non-woven fibrous web.

As used herein, the term "cross-machine direction (CD)" refers to the direction which is essentially perpendicular to the machine direction and in the plane of the machine direction defined above.

As used herein, the term "composite elastic material" (CEM) refers to a non-woven fabric including at least one layer of non-woven, elastic material and at least one layer of non-woven, non-elastic material, e.g., a gatherable layer. The CEMs of the invention include materials with combinations of layers that include at least one elastic web layer and at least one non-elastic web layer, e.g., an elastic layer between two gatherable layers. The elastic non-woven web layer(s) are joined or bonded in at least two locations to the non-elastic non-woven web layer(s). Preferably, the bonding is at intermittent bonding points or areas while the non-woven web layer(s) are in juxtaposed configuration and while the elastic non-woven web layer(s) have a tensioning force applied thereto in order to bring the elastic non-woven web to a stretched condition. Upon removal of the tensioning force after joining of the web layers, an elastic non-woven web layer will attempt to recover to its unstretched condition and will thereby gather the non-elastic non-woven web layer between the points or areas of joining of the two layers. The composite material is elastic in the direction of stretching of the elastic layer during joining of the layers and may be stretched until the gathers of the non-elastic non-woven web or film layer have been removed. A stretch-bonded laminate may include more than two layers. For example, the elastic non-woven web or film may have a non-elastic non-woven web layer joined to both of its sides while it is in a stretched condition so that a three layer non-woven web composite is formed having the structure of gathered non-elastic (non-woven web or film)/elastic (non-woven web or film)/gathered non-elastic (non-woven web or film). Yet other combinations of elastic and non-elastic layers may also be utilized. Such CEMs are disclosed, for example, in U.S. Pat. No. 4,720,415 to Vander Wielen et al., U.S. Pat. No. 5,385,775 to Wright, and particularly, for example, in WO 02/053365 and WO 02/053368, mentioned previously.

It is to be understood that both the foregoing general description and the following detailed description are exemplary and are intended to provide further explanation of the invention claimed. The accompanying drawings, which are incorporated in and constitute part of this specification, are included to illustrate and provide a further understanding of the wipes of the invention.

BRIEF DESCRIPTION OF THE DRAWINGS

The drawings are merely representative and are not intended to limit the scope of the claims. Like parts depicted in the drawings are referred to by the same reference numerals.

DETAILED DESCRIPTION OF THE INVENTION

Figure 1:
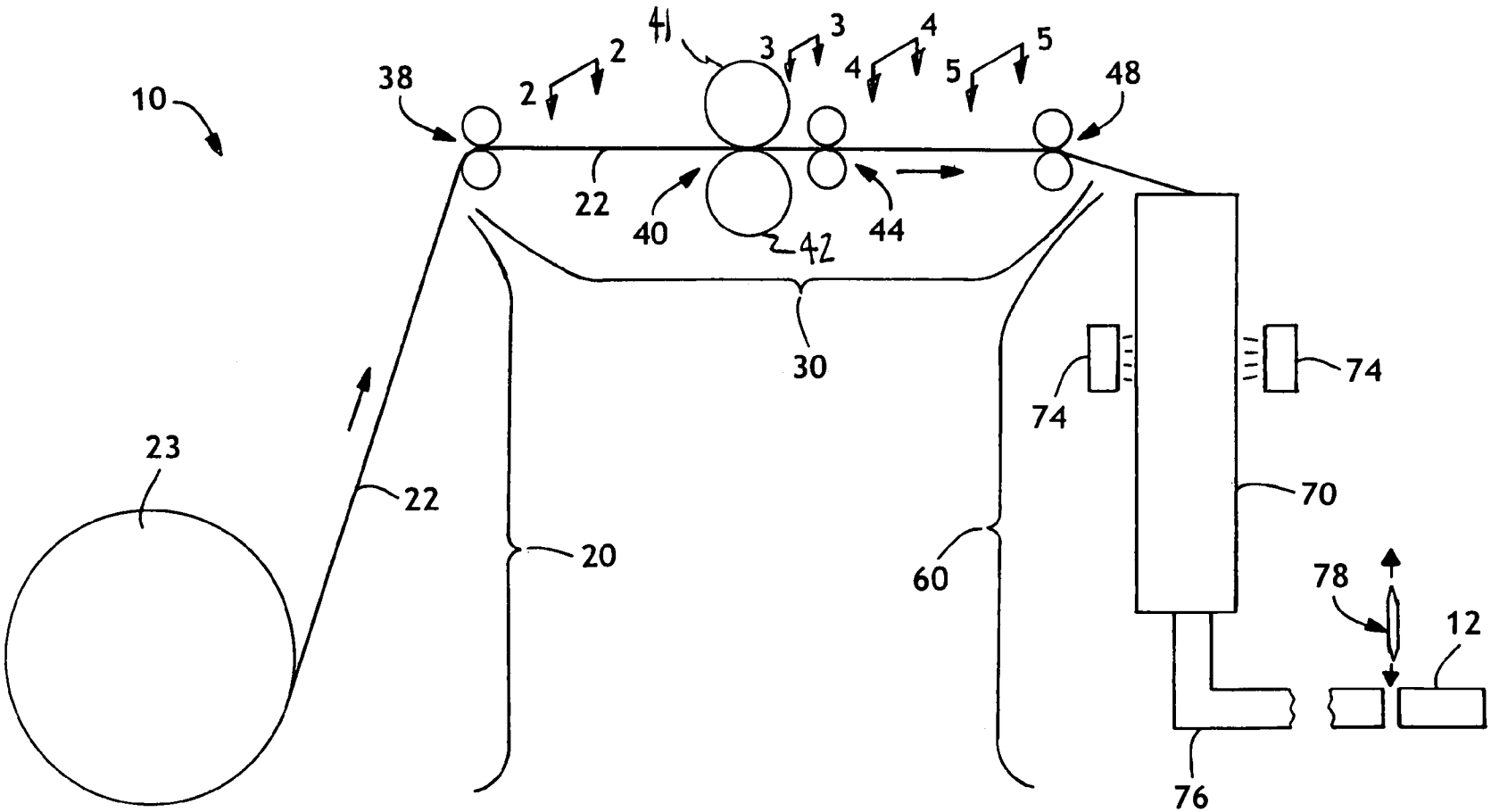
FIG. 1 representatively shows a schematic view of an apparatus and process for forming a stack of wipes from a common material, in accordance with the present invention.
Figure 2:
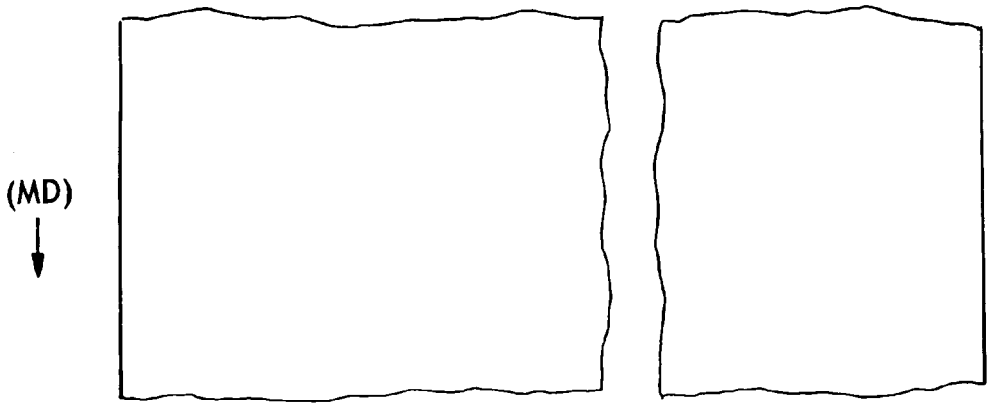
FIG. 2 representatively shows a top view of a portion of the common material traveling in the MD through the apparatus of FIG. 1, taken along the line 2—2.
Figure 5:
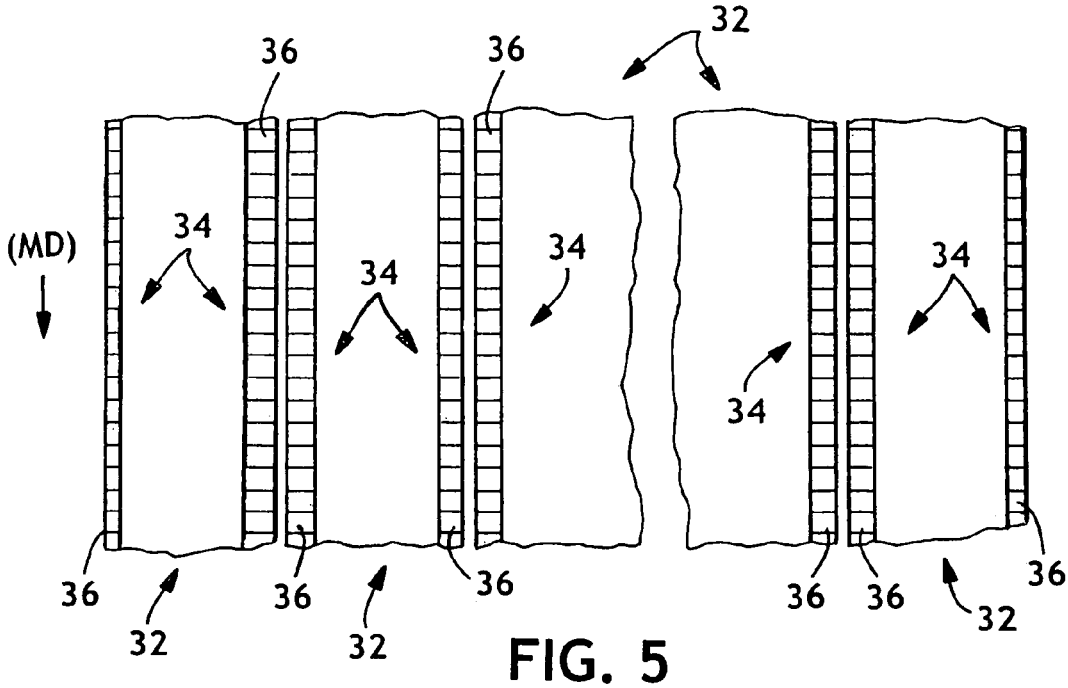
FIG. 5 representatively shows a top view of a portion of a common material traveling in the MD through the apparatus of FIG. 1, taken along the line 5—5.
Figure 2A:
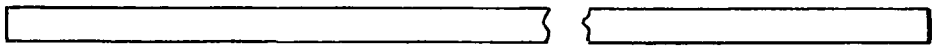
FIGS. 2A, 3A, 4A and 5A representatively show an enlarged cross sectional view of the common material, taken along lines 2—2, 3—3, 4—4, and 5—5, respectively.
Figure 5A:
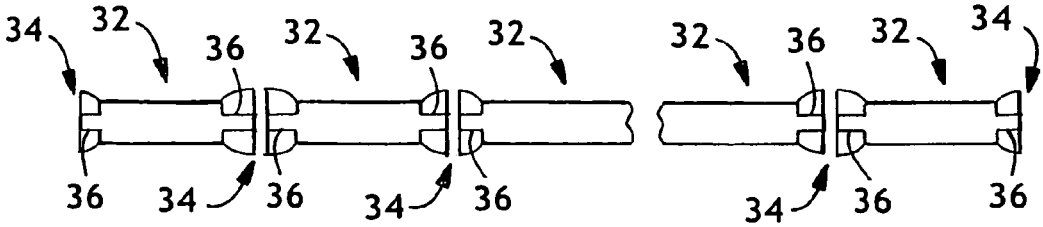
Figure 6:
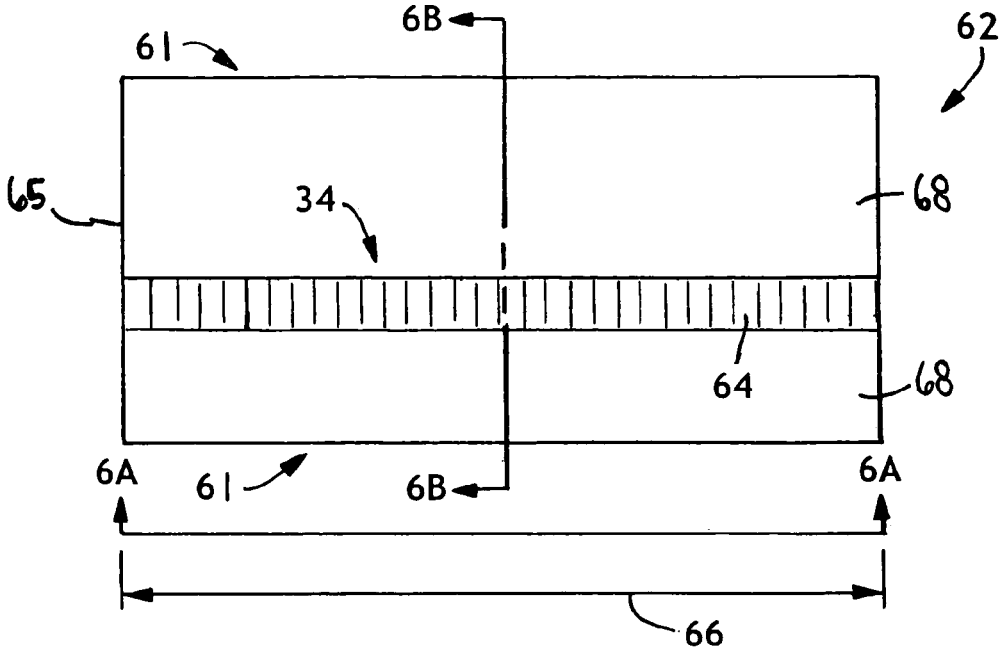
FIG. 6 representatively shows a top view of a wipe of the present invention, which may be in a z-fold configuration.
Figure 6A:
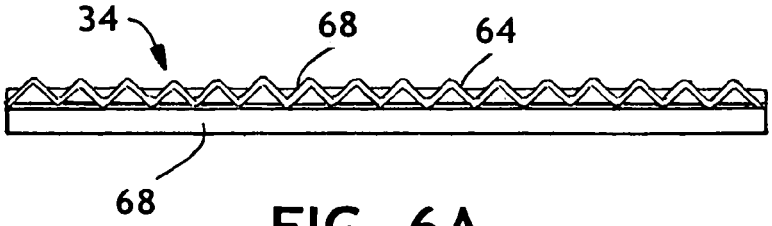
FIG. 6A representatively shows an enlarged side view of the wipe of FIG. 6, taken along the line 6A—6A.
Figure 6B:
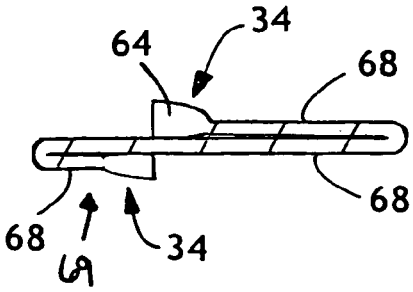
FIG. 6B representatively shows an enlarged cross sectional end view of the wipe of FIG. 6, taken along the line 6B—6B.
Figure 7:
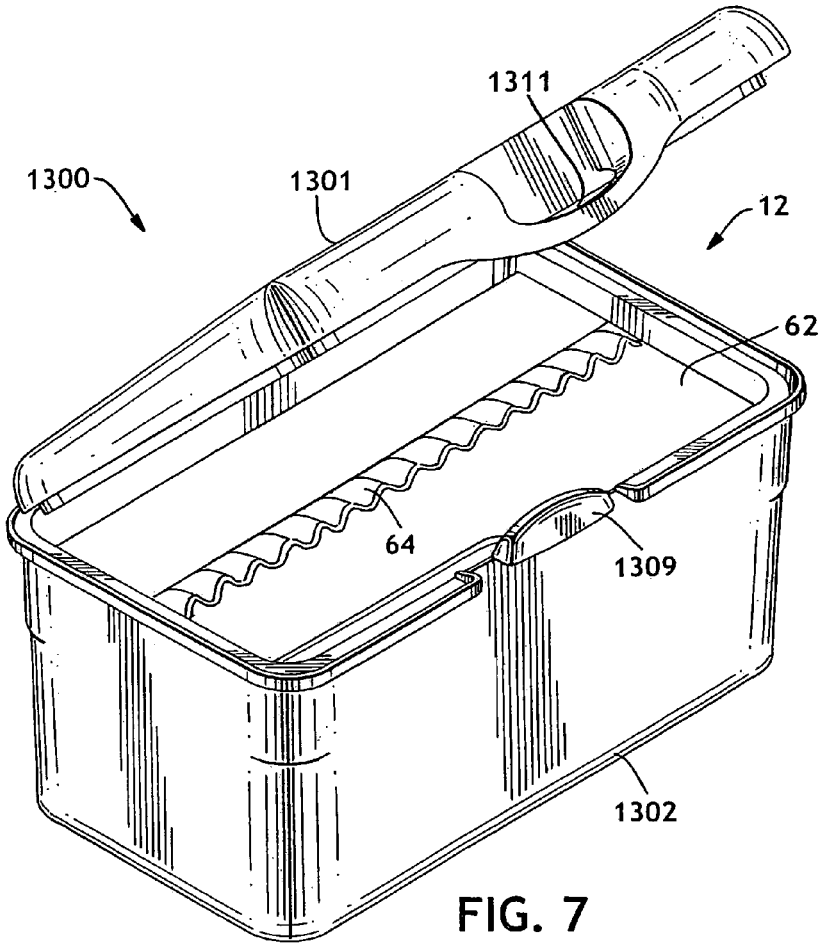
FIG. 7 representatively shows a perspective view of a type of dispenser for use with wipes of the present invention, where wipes are located therein and the dispenser is open.
Figure 8:
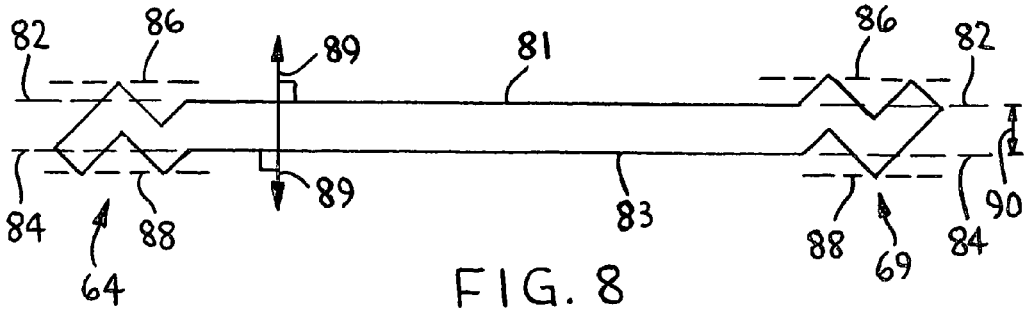
FIG. 8 representatively shows an enlarged side view of a wipe made in accordance with the present invention having an edge treatment.

As representatively illustrated throughout the figures, and for explanation now referring to FIG. 1, and supporting FIGS. 2 to 5A inclusive, there is depicted a system 10 and process for forming a stack 12 of wipes 62 (FIGS. 6 to 6B inclusive). Generally, system 10 includes a supply station 20, an edge treatment station 30 and a converting station 60, all through which a material 22 is formed into the stack 12 of wipes 62 for use in a wipes dispenser 1300 (FIG. 7). Material 22 is referred to as common material because the wipes 62 adjacent one another in the stack 12 are formed from what at one time is a unified piece of material, that is, material 22 which is common to each adjacent wipe (up to the total number of panels adjacent each other) during the formation process. Referring to FIG. 8, the web forming each wipe includes an edge portion 64 adjoining a main portion 68. Each wipe then has a top surface 81 and a spaced apart opposite bottom surface 83 and is further defined by a width of the web which is perpendicular to a length of the web. The top surface 80 of the main portion defines a top plane 82 and the bottom surface 83 of the main portion defines a bottom plane 84, where the top and bottom planes are parallel to one another and where a z-directional dimension 89 of the web extends through the top and bottom planes and is orthogonal to the top and bottom planes. At least one edge portion includes an edge treatment 34. Additional aspects of the system and wipe are now further explained.

The supply station 20 provides a supply of material 22. Material 22 maybe any material for use as a wipe, e.g., a nonwoven web such as coform, airlaid or CEM. The supply may be provided on-line or off-line. On-line means material 22 is provided to system 110 as the material itself is being formed contemporaneously with its successive use in system 10. Off-line means material 22 is separately formed well in advance of its use in system 10 so that material 22 is provided to system 10 in bulk form, such as on a roll 23 or other conventional bulk manner. From supply station 20, material 22 travels into edge treatment station 30.

The edge treatment station receives material 22. Material 22 may pass through a first speed control assembly 38 which maintains the material 22 at a first speed. For example, assembly 38 (as well as later assemblies 40, 44 and 48) may be conventional speed controllable nip rollers, S-wrap rollers, or similar functioning structure(s). From here, the material travels into an edge treatment assembly 40 which deforms the common material to define a plurality of panels 32 (FIG. 2, etc.), and such that each panel 32 is adjacent to at least one other panel 32. Deformation may include one or a combination of pressure and/or heat (e.g., without limitation, thermal embossing, ultra sonics, infrared, hot air knife, microwave) imparted to material 22. If the material includes polymer or other meltable material, such heat and/or pressure may cause slight melting of a portion of the material and then resolidifiction to conform to mating portions of assembly 40 (described further below). Simultaneous with edge treatment assembly 40, i.e., part of assembly 40 as seen in FIG. 1, or separately (not shown) but prior to assembly 40, station 30 may include a second speed control assembly which maintains material 22 at a second speed, where the second speed is about the same to greater than the first speed.

Figure 9:
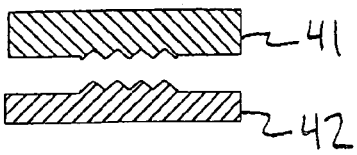
FIGS. 9–14 representatively show cross-sectional views of a portion of mating rolls formed with engaging non-random patterns for forming wipes of the present invention having an edge treatment.
Figure 10:
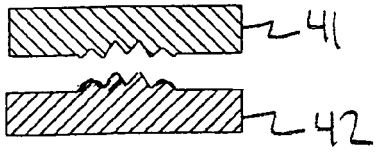
Figure 12:
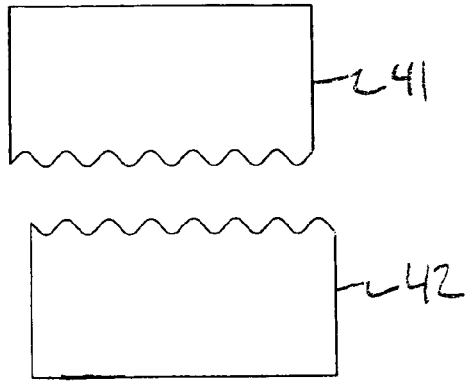
Figure 11:
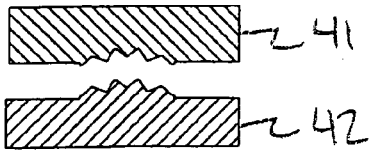
Figure 13:
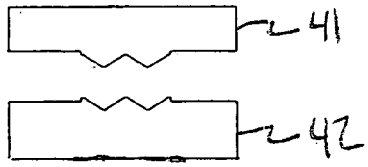
Figure 14:
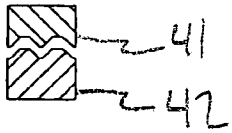
Figure 15:
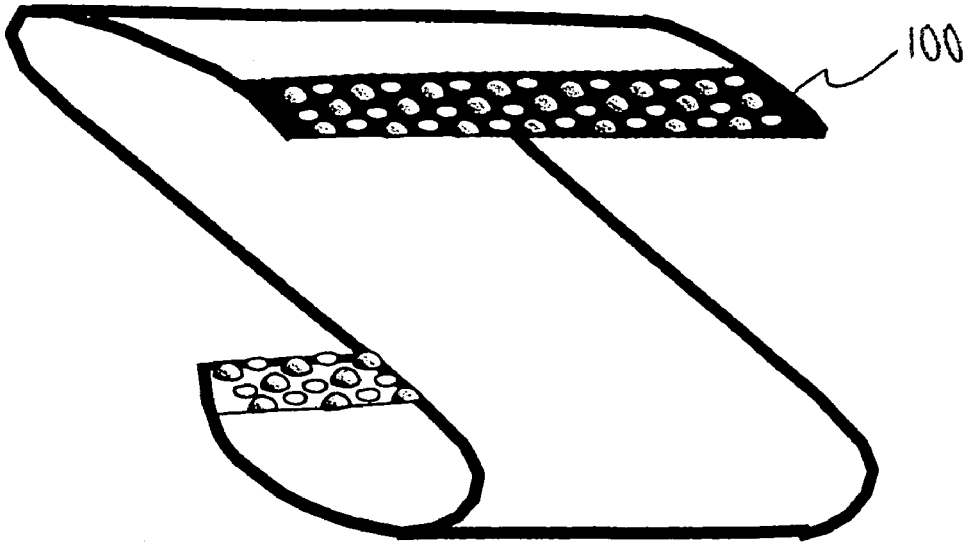
FIGS. 15–16 representatively show perspective views of wipes made in accordance with the present invention, having an alternative edge treatment.
Figure 16:
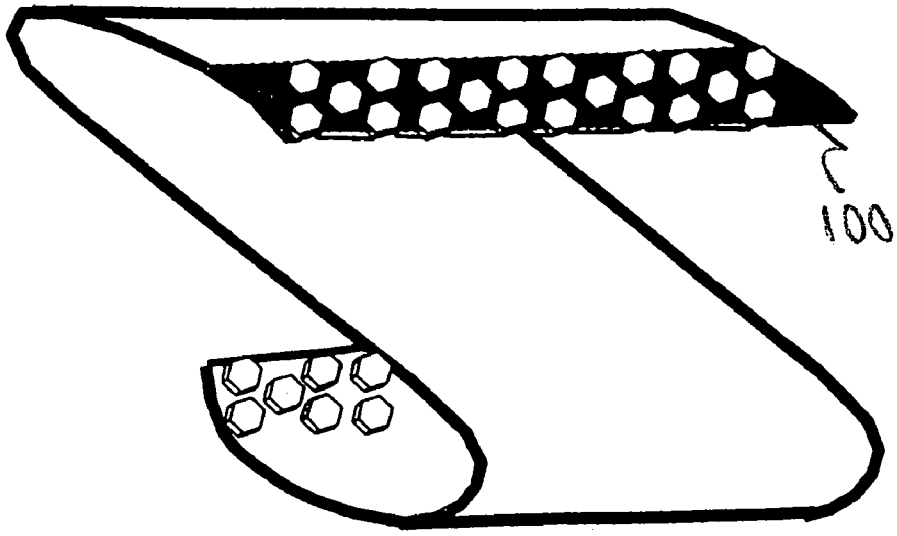
Figure 17:
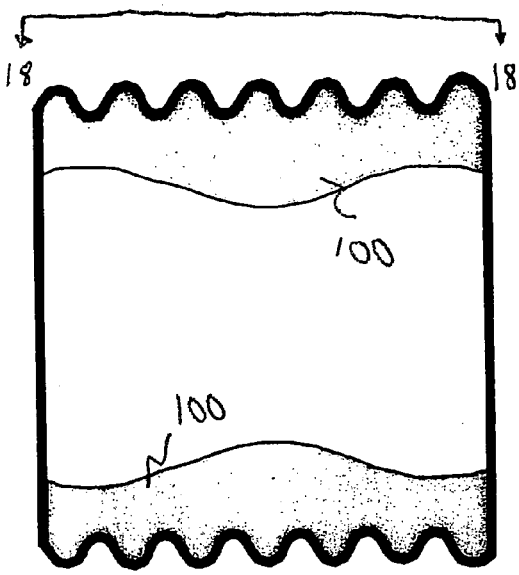
FIG. 17 representatively shows a top view of a wipe of the invention having a varied edge across the width of the wipe in an x-y directional dimension, as well as in a z-direction dimension (seen in FIG. 18).
Figure 19:
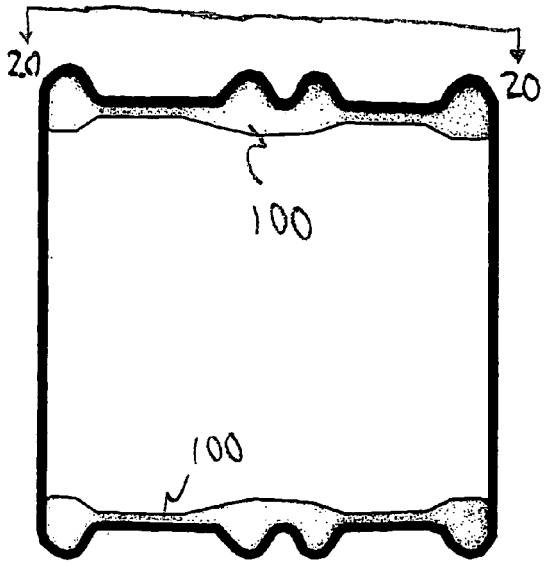
FIG. 19 representatively a top view of a wipe of the invention having a varied edge across the width of the wipe in an x-y directional dimension, as well as in a z-direction dimension (seen in FIG. 19).
Figure 18:
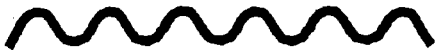
FIG. 18 representatively shows a side view of the wipes of FIG. 17, taken along the line 17—17.
Figure 20:
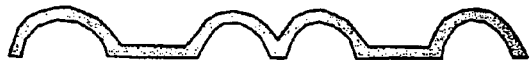
FIG. 20 representatively shows a side view of the wipes of FIG. 20, taken along the line 20—20.
Figure 21:
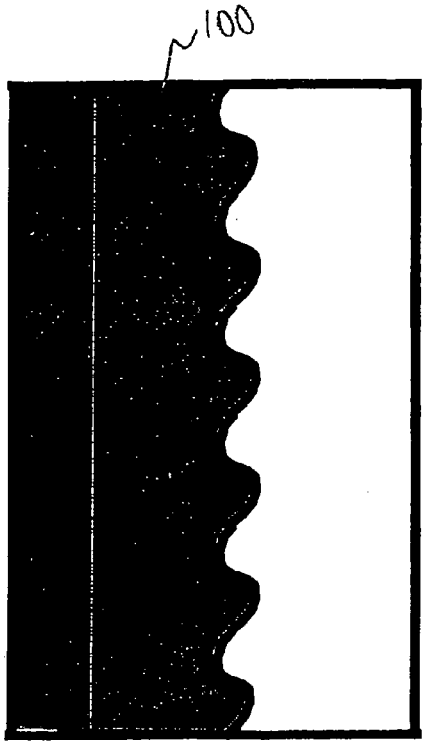
FIGS. 21–24 representatively show wipes of the invention optionally also having various types of visual differentiation cues.
Figure 23:
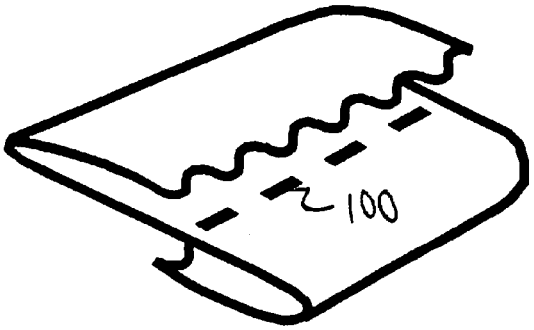
Figure 24:
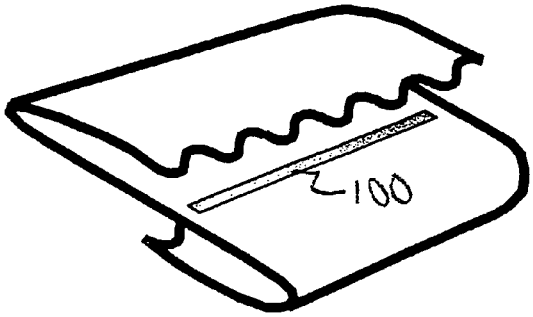
Figure 22:
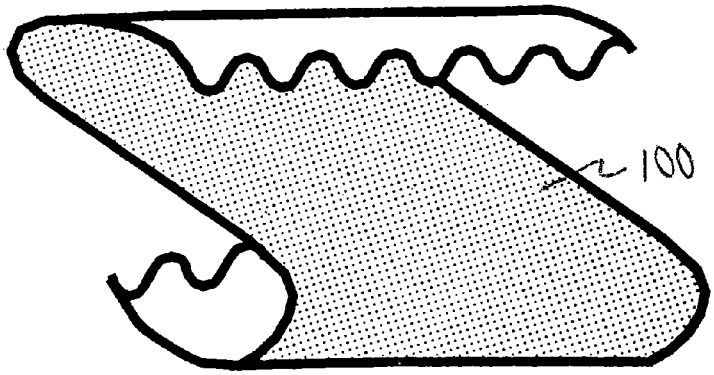

For example, edge treatment assembly 40 may be any conventional speed control unit used by one of ordinary skill in conjunction with the teachings herein, or similar functioning structure(s) in combination with conventional embossing type mating rollers that have been modified in accordance with the teachings of the invention herein. For example, such could be mating rolls 41 and 42 formed with engaging non-random patterns that correspond to deformation tracks (e.g., see FIGS. 9–14) like those formed at sides 36 in FIG. 3. For example, a variety of possible pattern rolls are shown in FIGS. 9 to 14. FIG. 9 shows a straight wave edge treatment for non-random pattern rolls (i.e., and which impart primarily MD deformation). FIG. 10 shows a crown with variable depth edge treatment for non-random pattern rolls (i.e., and which impart MD deformation with some CD deformation). FIG. 11 shows a crown with constant depth edge treatment for non-random pattern rolls (i.e., and which impart MD deformation with even more CD deformation). FIG. 12 shows a smooth curve wave edge treatment for non-random pattern rolls (i.e., and which impart primarily MD deformation). FIG. 13 shows an alternate straight wave edge treatment for non-random pattern rolls (i.e., and which impart primarily MD deformation). FIG. 14 shows yet an alternate straight wave edge treatment for non-random pattern rolls (i.e., and which impart primarily MD deformation). It should be understood that other techniques and structures known to those of skill in the art for deforming the material could also be used to practice the invention, in combination with the teachings herein. The particular deformation unit is not important. What is important is that the unit imparts sufficient heat and/or pressure to edge portion 64 of material 22 to affect the properties of the material to form an edge treatment along sides 36 whereby at least a portion of the edge portion is permanently deformed in a non-random pattern in the z-directional dimension. Additionally, the edge treatment may have a different retraction characteristic (i.e., more or less) than the retraction characteristic of the adjoining main portion of the material when tension on the material is lessened if such tension is applied to the material during the edge treatment process, and in this way the permanent deformation of the edge portion may be further embellished.

After traveling through assembly 40, the deformed material 22 goes through a first separating assembly 44 which separates the material 22 to form the plurality of panels 32 separated from each other. At this point station 30 has created the edge treatment 34 located along at least one side 36 of each panel. An example of an apparatus that could be readily employed to operate as separating assembly 40 is any conventional slitter used by one of ordinary skill in conjunction with the teachings herein, or similar functioning structure(s). It should be understood that other techniques and structures known to those of skill in the art for making a slit or cut in the material could also be used to practice the invention, in combination with the teachings herein.

While the accompanying drawings show the deforming and separating steps taking place in-line sequentially, it should be understood that such is not required. For example, one could form material 22 up to the separating assembly 44 and then wind up the edge treated only material for later use. At a later time and/or on a separate machine, one could take the already edge treated material 22 and then feed it into a separating assembly (i.e., and advantageously under tension similar to that when first edge treated if such tension existed when forming the edge treatment) and then continue to convert the panels into a stack of wipes (as discussed herein).

Figure 3:
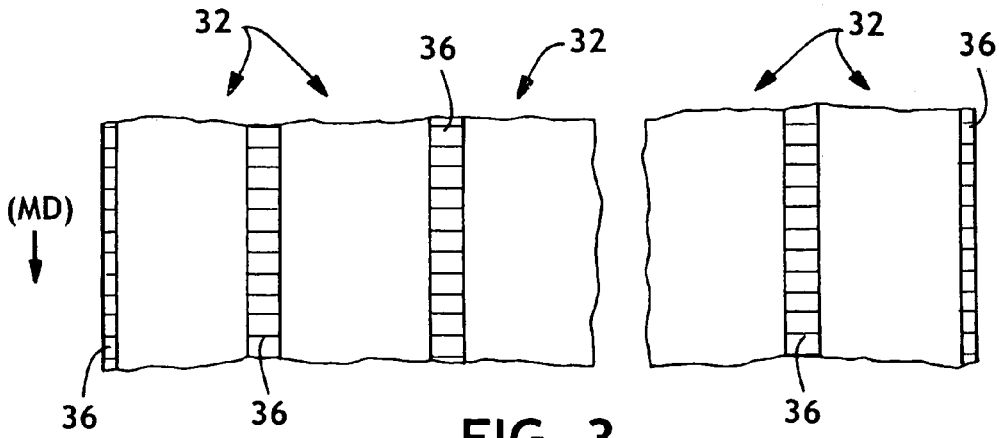
FIG. 3 representatively shows a top view of a portion of a common material traveling in the MD through the apparatus of FIG. 1, taken along the line 3—3.
Figure 4:
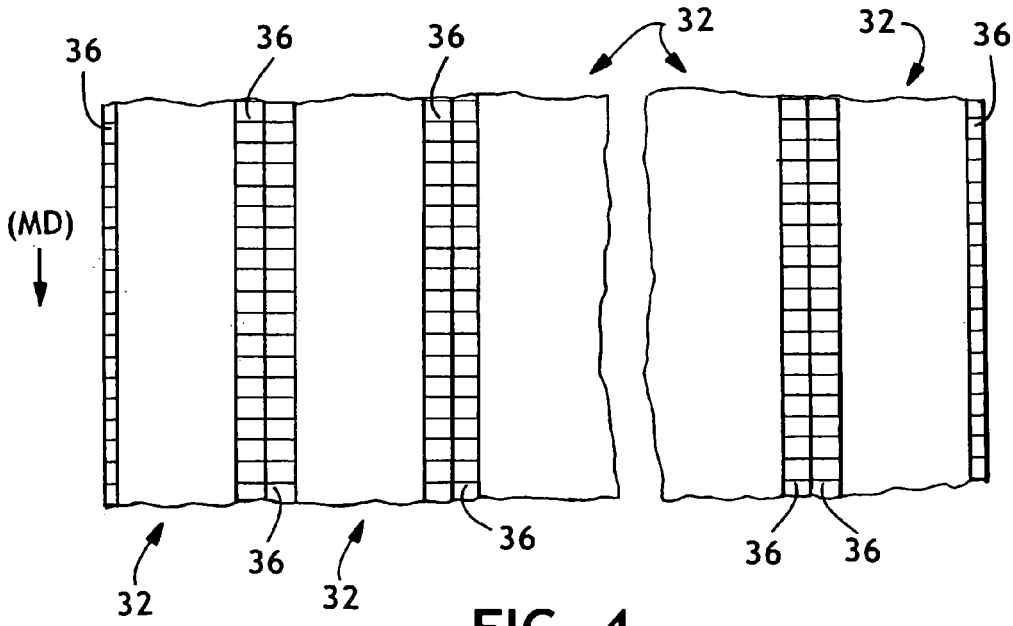
FIG. 4 representatively shows a top view of a portion of a common material traveling in the MD through the apparatus of FIG. 1, taken along the line 4—4.
Figure 3A:
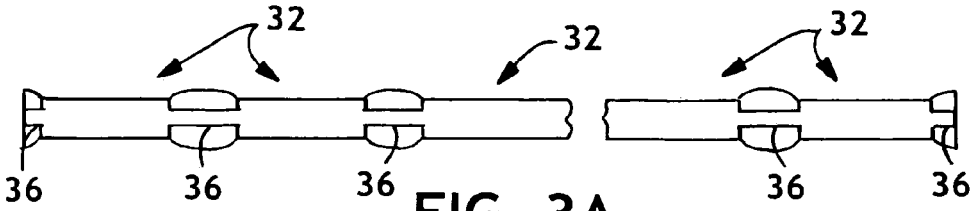
Figure 4A:
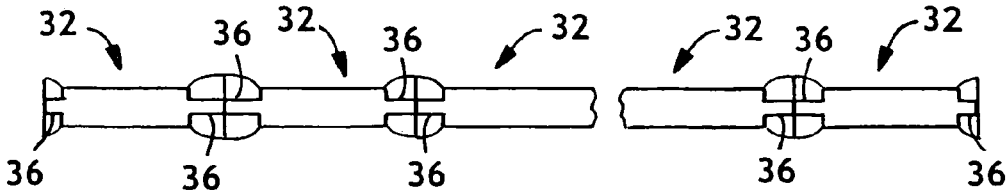

Simultaneous with separating assembly 44, i.e., part of assembly 44 as seen in FIG. 1, or separately (not shown) from assembly 44, station 30 may include a third speed control assembly which maintains the material (now in the form of separated panels 32) at a third speed, where the third speed is about the same as the second speed. Next, the material 22 may travel to a fourth speed control assembly 48 which maintains the material (now in the form of separated panels 32) at a fourth speed, where the fourth speed is about the same as to less than the third speed. At this point, station 30 can accentuate the edge treatment 34 located along at least one side 36 of each panel 32 if differential speeds were used between the first and fourth speed control assemblies, e.g. with CEM. Alternatively, and advantageously, the separating assembly may be configured to separate the edge treatment (e.g., at sides 36 as seen in FIGS. 3 and 3A) somewhere within the edge treatment (e.g., as in FIGS. 4 and 4A) so as to create the edge treatment 34 located along both sides 36 of each panel 32 (e.g., as seen in FIGS. 5 and 5A).

Formation of edge treatment 34 in wipes can be achieved by a variety of techniques. For example one technique is to permanently deform the portion of the edge in the non-random pattern in the z-directional dimension 89 such that the top surface of the edge portion defines a top edge plane and the bottom surface of the edge portion defines a bottom edge plane wherein at least one of the top edge plane and the bottom edge plane is outside of a bounded region defined between the top and bottom planes of the main portion. Alternatively, formation of edge treatment 34 in wipes can be achieved by permanently deforming the portion of the edge in the non-random pattern in the z-directional dimension whereby the edge portion has an Edge Resilient Value (as determined herein) and the main portion has a Main Resilient Value (as determined herein) such that the Edge Resilient Value is greater than the Main Resilient Value. In this regard, it can be advantageous, and in order of increasing advantage, if the Edge Resilient Value is at least 10%, at least 20%, at least 30%, or at least 50%, greater than the Main Resilient Value. Still alternatively, formation of edge treatment 34 in wipes can be achieved by permanently deforming the portion of the edge in the non-random pattern in the z-directional dimension whereby the edge portion has an Edge Length Value (as determined herein) and the main portion has a Main Length Value (as determined herein) such that the Edge Length Value is greater than the Main Length Value. In this regard, it can be advantageous, and in order of increasing advantage, if the Edge Length Value is at least 5%, at least 15%, at least 25%, at least 35%, or at least 50%, greater than the Main Length Value. Also, the Length Value can be determined from with the MD or the CD of the wipe.

Without being limited to a theory of understanding, such edge treatment formation techniques are believed to be, and analysis has confirmed such, a result of one or more or a combination of the following: the structure and/or compositions of the fibers used in the non-woven web; the temperature of the edge treatment assembly (e.g., pattern rolls 41 and 42); the pressure exerted upon the non-woven web at the edge portion by the edge treatment assembly (e.g., through pattern rolls 41 and 42); and/or densification of the non-woven web at the edge portion by the treatment assembly (e.g., through pattern rolls 41 and 42). Still further, to achieve the desired deformation of the edge portion as defined herein above, it is necessary to impart a "permanent" characteristic to the edge portion with the edge treatment. For example, such may be obtained through use of polymeric fibers (or fibers that behave like polymeric fibers in terms of taking on shape and being deformable) that are solid at room temperature but can be easily deformed when subjected to heat and/or pressure and will thereby take on and maintain a new shape once the energy imparted by the heat and/or pressure dissipates into the surrounding environment. Alternatively, or additionally, the "permanent" characteristic may be obtained through applying a coating to the non-woven web as it passes through the edge treatment assembly (e.g., an adhesive or other shape maintaining substance that could be applied to the web or transferred from the pattern rolls 41 and 42 to the web as it passes through them) and thereby cause the sheet to retain the pattern imparted upon the web by the pattern rolls.

Still without being limited to a theory of understanding, it is believed that the edge treatment creates an interruption of the surface of the edge portion of the wipe in contact with the main portion of the wipe (i.e., when the wipe is in a folded configuration). This reduces the cohesion between the contacting portions of the wipe and helps create an edge portion that can be more easily grasped. Stated another way, the edge treatment, and in particular densification of the web, can modify the surface energy of the wipe to thereby help to reduce the cohesion between the contacting portions of the wipe, for easier edge location and wipe dispensing. Still further, the edge treatment can reduce the permeability of the wipe which reduces the wet ability of the wipe in the treated area, thereby making it easier to locate the edge and then dispense the wipe.

The edge treatment can also provide a visual cue to assist in locating the lending edge of the wipe, particularly when in a stack of folded wipes. Referring to FIGS. 15 to 22, use of an edge treatment is depicted as a visual differentiation cue, as well as use of a pattern and/or a color in this regard also. The visual differentiation cue may be included on the bottom or top portions of the edge portion, or on bottom or top surfaces of the main portion, just so long as the edge portion is visually differentiated from the main portion of the wipe when the wipe is folded upon itself.

As an additional benefit, and also without being limited to a theory of understanding, it is believed that the edge treatment located along at least one side 36 of each panel can be further embellished is by differential retraction of material 22, namely, the edge treatment can be caused to retract at a different rate than the adjoining main portion of each panel. For example, this may be accomplished in one way by varying the speed of material 22 when traveling between the first and fourth speed control assemblies 38 and 48, respectively. That is, by operating assembly 38 at a first speed, and operating the second speed control assembly (i.e., assembly 40 in FIG. 1) at a second speed that is greater than the first speed, then the material is caused to stretch between assemblies 38 and 40. In the stretched condition, the material may be subjected to a treatment in the MD along a portion of the material (e.g., heat, pressure, embossing, thermal embossing, other treatments mentioned previously, a combination of these) to define MD panels. Once the panels are formed, and advantageously (though not required) while also in this stretch condition, the material may be separated between panels by the separating assembly 44 (e.g., by cutting, slitting, or similar means to accomplish the desired separating), where the third speed control assembly (i.e., assembly 44 in FIG. 1) may be operated at about the same speed as assembly 40. Alternatively, the separating could occur later, but such may not be advantageous from a processing perspective. Regardless when the separating is performed, after the panels are formed in the MD, and because of the treatment applied to the material by assembly 40, when the material is allowed to relax or retract, it will tend to do so differently at the edge treatment location from the adjoining main portion of the panel that was not so treated. The material may be allowed to relax or retract when the fourth speed control assembly 48 operates at a fourth speed which is less than the speed of the third speed control assembly (i.e., assembly 44 in FIG. 1). By varying the speed of assemblies 44 and 48 in this way, the untreated material that wants to retract to its original unstretched condition is allowed to do so. However, when doing so, it is observed that the edge treated portion does not retract much, if at all. It is the differential retraction that can be used to enhance or embellish the edge treatment along the side of the panels, and such is particularly prominent when the edge treatment is separated somewhere between its outer bounds so the loose side(s) of each panel is only confined by one adjoining main portion of the panel. Also, the quality of the edge treatment formed in the edge treatment may be varied by varying the combination of heat and/or pressure used to perform the deformation, as well as varying the elastic properties of the material and/or the amount of stretch applied to the material between assemblies 38 and 48, respectively. In sum, it is contemplated that all materials which can be caused to have such differential retraction when subjected to stretched and unstretched conditions may be used to embody the subject invention to embellish upon the edge treatment taught for low elastic to non-elastic materials, and for example, where CEMs may be advantageous but are not required. Similarly, it is further contemplated that all treatments which can be used to impart such differential retraction upon a material which is subjected to stretched and unstretched conditions may be used to embody the subject invention, and for example, where thermal embossing may be advantageous but is not required.

Next, converting station 60 receives the material 22 (now in the form of separated panels 32 with edge treated sides) from assembly 48 and then converts the plurality of separate panels 32 into a plurality of wipes 62. For example, such converting may be performed by a folding assembly 70 which folds the plurality of panels 32 into a plurality of folded panels. Each of the plurality of folded panels may be positioned relative to each adjacent folded panel to form a ribbon 76 of folded panels 32. An example of an apparatus that may be employed to operate as station 60 may be a conventional web or material folding unit used by one of ordinary skill in conjunction with the teachings herein, or similar functioning structure(s). It should be understood that other techniques and structures known to those of skill in the art for converting the material into wipes could also be used to practice the invention, in combination with the teachings herein.

From folding assembly 70, ribbon 76 travels to a second separating assembly 78 of converting station 60. Assembly 78 separates the ribbon to form a plurality of wipes 62 into the stack 12 of wipes. As formed (e.g., FIGS. 6 to 6B in one possible configuration), each wipe 62 of the plurality of wipes includes the leading edge portion 64 with the edge treatment 34 located along at least a portion of a length 66 of the leading edge portion 64. The leading edge portion is generally defined as that part of the wipe from the tip of the lead edge back towards the adjoining main portion up to the first fold of the wipe if folded or the leading 30% of the length of the wipe if not folded. The edge treatment need not extend from the tip of the leading edge back towards the adjoining main portion but could be set back from the tip of the leading edge and then extend back towards the adjoining main portion (i.e., so as to form the edge treatment between two non edge treatment location such as the main portion and with the edge treatment still located in the leading edge portion). The edge treatment is distinct from an adjoining main portion 68 of each wipe and each wipe is positioned relative to adjacent wipes 62 to form the stack of wipes 12. The edge treatment may be from about 1 mm deep to about 3 cm deep (i.e., measuring from the tip of the leading edge back towards the adjoining main portion) or deeper if desired, and advantageously about 1 cm+/−1 cm. As seen in FIG. 6A, edge treatment 34 is formed where material is permanently deformed in a non-random pattern in the z-dimensional direction, as discussed previously. In addition, different retraction characteristics between edge treatment 34 and the adjoining main portion 68 may be employed, and the thickness (also called caliper) of these portions of the material may differ. For example, the material in edge treatment 34 may be thinner than the material in main portion 68 (e.g., due to the deformation and/or differential retraction characteristics).

An example of an apparatus that may be employed to operate as assembly 78 may include a conventional cooperating rotary cutter and anvil roller. Stacks 12 may be alternately referred to as clips of wipes when the stacks 12 are made into a larger stack of like clips or stacks 12. In such a case, the stacks/clips may then pass to a stacker assembly (not shown). In the stacker assembly, the stacks/clips may be stacked one upon another into a larger stack. A desired number of stacks/clips are stacked one on top of another in this manner. Then, the completed stack of stacks/clips may be moved to a packaging assembly (not shown) where the stacks/clips may be put in various types of dispensers (e.g., tubs, bags, etc.) and then made ready for commercial sale and use. Any conventional the stacker assembly could be used by one of ordinary skill in conjunction with the teachings herein, or similar functioning structure(s). It should be understood that other techniques and structures known to those of skill in the art for making clips and/or stacks of wipes could also be used to practice the invention, in combination with the teachings herein.

Additionally, as the separated panels 32 travel through the assembly 70, they may encounter a moistening assembly 74. Assembly 74 may be an elongate horizontal bar having ports for imparting liquid or solution onto the moving panels as they are folded and formed into ribbon 76. A liquid or solution may be provided at a desired add-on rate and in a conventional manner to the elongate horizontal bar so solution may be applied through the ports to the moving panels 32. Such application may include spraying or drooling with an elongate horizontal bar, or may include alternate structures (not shown) for techniques such as printing, a bath, a flooded nip, or hollowed out folding boards with spray orifices, all which would project fluid in a rather even horizontal plane as the panels 32 move through assembly 70. However, if a dry final product is desired the moistening assembly 74 may be eliminated or just not used, and otherwise the system and process may be the same.

In another aspect, the invention includes a process for forming the stack 12 of wipes 62 (e.g., using system 10). Generally, the process includes providing the supply of the common material 22. Then, the process includes forming the plurality of panels 32, each panel adjacent to at least one other panel. Next, and/or simultaneously, the process includes creating the edge treatment located along at least one side 36 of each panel 32. The steps of forming and creating may be accomplished, for example, by: (i) permanently deforming material 22, e.g., thermally embossing, a portion of the material along at least one edge of each panel 32; and (ii) slitting the material along the deformed portion of the material to form the plurality of separate panels 32. Additionally, if a CEM is used as material 22, the steps of (iii) stretching the CEM before deformation and (iv) relaxing the plurality of separate panels 32 to embellish the edge treatment, may be used. Finally, the process includes converting the plurality of panels 32 into the plurality of wipes 62, and positioning each wipe relative to adjacent wipes to form the stack of wipes. As such, each wipe 62 of the plurality of wipes includes the leading edge portion 64 with the edge treatment 34 located along at least a portion of the length of the leading edge portion 64 and the edge treatment being distinct from the adjoining main portion 68 of each wipe.

Additionally, the process and wipes, may include one or more of the following features. Each wipe may be folded upon itself at least once, e.g., achieved through folding assembly 70, and even folded upon itself twice or more as desired. If a moistening solution is used, the plurality of wipes 62 may be a plurality of wet wipes. The edge treatment 34 may extend along substantially an entire length of the leading edge portion 64. As taught, the stack of wipes 62 is configured in a reach-in format to dispense the wipes from the wipes dispenser 1300. Each wipe 62 in the plurality of wipes may be discrete from each adjacent wipe. Each wipe 62 of the plurality of wipes may include a trailing edge with the edge treatment 34 located along at least a portion of the length of the trailing edge 69, in addition to or rather than, the edge treatment along the leading edge portion 64. Each wipe may have at least a second edge portion (e.g., 65 or 69) distinct from the edge and the second edge portion may include the edge treatment along at least a portion of the second edge portion. Each wipe may be non-interfolded with each adjacent wipe. Each wipe 62 may be folded such that the leading edge portion 64 is located between opposite sides 61 of the wipe when the wipe is folded upon itself.

The plurality of wipes 62 of the present invention, e.g., wet wipes, may be arranged in a package or dispenser in any manner which provides convenient and reliable one at a time dispensing, as taught herein. For example, the wipes may be arranged in a dispenser or package as a plurality of individual sheets arranged in a stacked configuration to provide a stack of wipes which may or may not be individually folded. The wipes may be individual wipes which are folded in a c-fold, z-fold, quarter fold or other zigzag fold or non-interfolded configurations as are known to those skilled in the art. The stack 12 may include a plurality of wipes 62 stacked one on top of each other in a non-interfolded configuration. For such a "non-interfolded" wipe, each wipe is folded onto itself with no portion of another wipe being positioned between or underneath any portion the folds of the adjacent wipe(s). These configurations for wipes, as well as those discussed above, may be provided by means known to those skilled in the art.

Referring generally to the Figures now, the plurality of wipes 62, such as a stack 12 of wipes, may include any suitable number of individual wipes depending upon the desired packaging and end use. For example, the plurality may be configured to include a stack of wipes which may include at least about 5 wet wipes, from about 16 to about 320 individual wipes, or from about 32 to about 160 wipes. The size and shape of the final stack of wipes is dependent upon the size and shape of the package/dispenser and vice versa. For example, the length of an assembled stack of wipes may be about 190 mm, with a height of about 90 mm and a width of about 100 mm.

Each wipe may be generally rectangular in shape and define a pair of opposite sides and a pair of opposite end edges which may be referred to as a leading edge and a trailing edge. The leading edge of each wipe is typically positioned in the package/dispenser to be grasped by a user to facilitate a removal of the wet wipe from the package/dispenser. Each wipe defines an unfolded width and an unfolded length. The wipe may have any suitable unfolded width and length. For example, the wipe may have an unfolded length of from about 2.0 to about 80.0 centimeters and desirably from about 10.0 to about 26.0 centimeters and an unfolded width of from about 2.0 to about 80.0 centimeters and desirably from about 10.0 to about 45.0 centimeters. In reference to FIG. 6, the width of a wipe is defined along dimension 66 and the length of a wipe along the perpendicular dimension in the same plane.

Materials suitable for wipes of the present invention are well known to those skilled in the art. The wipes may be made from any material suitable for use as a wipe, and which may but need not have an elastic characteristic in at least the MD, including nonwoven webs (e.g., meltblown, coform, airlaid, bonded-carded web materials) spunlace materials, hydroentangled materials, tissue materials, paper materials, high wet-strength tissue and the like and may comprise synthetic or natural fibers or combinations thereof. The wipes may have a dry basis weight of from about 25 to about 120 grams per square meter and desirably from about 40 to about 90 grams per square meter. In a particular aspect, the wipes may comprise a CEM, having a basis weight of from about 60 to about 100 grams per square meter and desirably about 80–85 grams per square meter. An example of such a CEM for use in the present invention are discussed above in the Definitions section and may be found as the baby wipes product presently sold by Kimberly-Clark Corporation and known as HUGGIES® Supreme Care baby wipes.

In another aspect of the invention, wipes 12 may contain a liquid which may be any liquid or solution which may be absorbed into the wipes (e.g., water based, oil based, others), thus making them wet wipes. The wipes may be moistened at any time before the wipes are actually used by the consumer. Preferably they are moistened some time during the manufacturing process before or contemporaneous with the plurality of wipes being sealed in a dispenser or other packaging for next use by a product user. The liquid contained within the wet wipes may include any suitable components which provide the desired wiping properties. For example, the components may include water, emollients, surfactants, preservatives, chelating agents, pH buffers, fragrances or combinations thereof. The liquid may also contain lotions, ointments and/or medicaments. An example of such a liquid for use in the present invention is found in the baby wipes product presently sold by Kimberly-Clark Corporation and known as HUGGIES® Natural Care baby wipes or Supreme Care baby wipes. The amount of liquid or solution contained within each wet wipe may vary depending upon the type of material being used to provide the wet wipe, the type of liquid or solution being used, the type of container being used to store the stack of wet wipes, and the desired end use of the wet wipe. In a particular aspect wherein the wet wipe is made from CEM, the amount of liquid contained within the wet wipe is from about 250 to about 400 weight percent and desirably about 330 weight percent based on the dry weight of the wet wipe. If the amount of liquid is less than the above-identified range, the wet wipes may be too dry and may not adequately perform depending on the desired task. If the amount of liquid is greater than the above-identified range, the wet wipes may be over saturated and soggy and the liquid may pool in the bottom of the container.

An example of rigid containers suitable for use with the present invention are found in the products presently sold by Kimberly-Clark Corporation for reach-in style wipes and known as HUGGIES® Natural Care baby wipes or HUGGIES® Supreme Care baby wipes. FIG. 7 shows such a rigid plastic wet wipes dispenser 1300. Each dispenser 1300 includes a lid 1301 hingedly attached to a base 1302. The dispensing opening is coextensive with the inside perimeter of the container, and is through which individual wet wipes are removed from the inside cavity in a reach-in format. The lid is secured in a closed position by a suitable latching mechanism, in which a protrusion 1309 in the front lip of the base is engaged by an opening 1311 in the front lip of the lid. In use, the lid is opened and then access to the inside cavity is gained. The user then passes his or her hand, etc. through the container opening to grab the first wipe in the stack of wipes. Once the user grabs the wipe, it may then pass through the opening as the user pulls it up. The user may pass the complete wipe through the dispensing opening and out of the container or package. After the desired number of wipes are taken, the lid may be sealed closed. An example of non-rigid containers for use with the present invention may be found in the baby wipes refill packages presently sold by Kimberly-Clark Corporation and known as HUGGIES® Natural Care or HUGGIES® Supreme Care baby wipes resealable refill packs.

Test Methods

The testing set forth herein is performed where wipe, or portion thereof as applicable, samples are conditioned 24 hours and tested under TAPPI standard conditions of 23±1° C. and 50±2% RH. The test equipment discussed is exemplary and should be used to conduct the testing, however, alternative equipment that is equivalent in all material respects for the given test can be used also (but in the event of conflict between test results the test results from the exemplary equipment shall control).

Thickness Measurement

The "Thickness" of the applicable portion of a wipe (e.g., edge portion or main portion) of the invention is found using a Compression Tester model KES-FB-3 manufactured by Kato Tech Co., Ltd of Japan, and as set forth herebelow. The sample is prepared by separating (e.g., by cutting with a scissors, knife or other separating device that will not otherwise alter the edge treatment portion or main portion from how each is intended for use as a wipe) the edge portion having the edge treatment (e.g., the portion 34 seen in FIGS. 6, 6A and 6B) from the adjacent main portion (e.g., the portion 68 seen in FIGS. 6, 6A and 6B). The thickness of the sample is found by a single cycle compression of the sample between two circular stainless steel plungers, each plunger having an area, e.g., of 2 $cm^2$, but where the cited pressures are based on the size of the sample tested. The sample is positioned between the plungers and extends from one side to the other along the diameter of the plungers. The velocity of compression is 20 micron/sec. When the pressure attains a level of 50 grams force/$cm^2$ (gf/$cm^2$) the top plunger retracts at the same velocity of 20 micron/sec. and recovery of the compressed material begins. The thickness is taken during the compression of the sample at the pressure of 0.5 gf/$cm^2$ as the plungers first move towards each other. Ten samples (i.e., one sample from each of ten different wipes) are tested in this manner and the thickness in millimeters (to the nearest tenth of a millimeter) for each sample is added together and the collective total thickness divided by ten, which thereby determines the Thickness of the applicable portion, which is discussed herein and set forth in the claims.

Resilient Value Measurement

The "Resilient Value" of the applicable portion of a wipe (e.g., Edge Resilient Value for edge portion or Main Resilient Value for main portion) of the invention is found using a Compression Tester model KES-FB-3 manufactured by Kato Tech Co., Ltd of Japan, and as set forth herebelow. The sample is prepared by separating (e.g., by cutting with a scissors, knife or other separating device that will not otherwise alter the edge treatment portion or main portion from how each is intended for use as a wipe) the edge portion having the edge treatment (e.g., the portion 34 seen in FIGS. 6, 6A and 6B) from the adjacent main portion (e.g., the portion 68 seen in FIGS. 6, 6A and 6B) (herein the "Edge" sample). A strip of the sample from the main portion which is adjacent the edge portion with the edge treatment is also separated from the remainder of the main portion, the strip having the same length and width dimensions (relative to the as manufactured wipe) as the separated edge portion having the edge treatment (herein the "Main" sample). The resilience of the Edge sample is found by a single cycle compression of the sample between two circular stainless steel plungers, each plunger having an area of 2 $cm^2$, but where the cited pressures are based on the size of the sample tested. The sample is positioned between the plungers and extends from one side to the other along the diameter of the plungers. The velocity of compression is 20 micron/sec. When the pressure attains a level of 50 grams force/$cm^2$ ($gf/cm^2$) the top plunger retracts at the same velocity of 20 micron/sec. and recovery of the compressed material begins. The thickness is taken during the compression of the sample first (1) at the pressure of 0.5 $gf/cm^2$ and then second (2) at the pressure of 50 $gf/cm^2$, as the plungers first move towards each other. The Edge resilient value is determined as the ratio of the Edge thickness in millimeters (to the nearest tenth of a millimeter) of the first (1) Edge thickness measurement at the pressure of 0.5 $gf/cm^2$ to the second (2) Edge thickness measurement at the pressure of 50 $gf/cm^2$. The Main resilient value is determined as the ratio of the Main thickness in millimeters (to the nearest tenth of a millimeter) of the first (1) Main thickness measurement at the pressure of 0.5 $gf/cm^2$ to the second (2) Main thickness measurement at the pressure of 50 $gf/cm^2$. Ten samples (i.e., one sample of each portion from each of ten different wipes) are tested in this manner. The Edge resilient value for each sample is added together and the collective edge resilient value divided by ten, which thereby determines the Edge Resilient Value of the edge portion, which is discussed herein and set forth in the claims. The Main resilient value for each sample is added together and the collective main resilient value divided by ten, which thereby determines the Main Resilient Value of the main portion, which is discussed herein and set forth in the claims.

Length Value Measurement

The "Length" of the applicable portion of a wipe (e.g., Edge Length Value for edge portion or Main Length Value for main portion) of the invention is found using a Compression Tester model KES-FB-3 manufactured by Kato Tech Co., Ltd of Japan, and as set forth herebelow. The sample is prepared by separating (e.g., by cutting with a scissors, knife or other separating device that will not otherwise alter the edge treatment portion or main portion from how each is intended for use as a wipe) the edge portion having the edge treatment (e.g., the portion 34 seen in FIGS. 6, 6A and 6B) from the adjacent main portion (e.g., the portion 68 seen in FIGS. 6, 6A and 6B)(herein the "Edge" sample). A strip of the sample from the main portion which is adjacent the edge portion with the edge treatment is also separated from the remainder of the main portion, the strip having the same length and width dimensions (relative to the as manufactured wipe) as the separated edge portion having the edge treatment (herein the "Main" sample). Two dot marks are placed on each of sample in the desired orientation, MD or CD which is being evaluated, 10 millimeters apart from each other, and in the case of an Edge sample also placing the dots on either side of at least one permanent deformation in the edge treatment portion. The length of the Edge sample is found by a single cycle compression of the sample between parallel rigid clear plastic plates (e.g., attached to the plungers of the Compression Tester). The sample is positioned between the plates and along a length centerline of the plates. The plates must be sufficiently larger than the length and width of the sample and made to compress the sample sufficiently to flatten the Edge sample such that there are not any visible folds or buckles in the Edge portion when looking at a side view of the Edge portion between the two plates. It is important that as the Edge portion is compressed it is not allowed to fold or otherwise form a crease in its surface due to the compressing. If this occurs, the sample must be discarded and a new sample used. To avoid this happening, a piece(s) of transparent tape can be attached to the edge(s) of the Edge sample and minimal force can be applied to manually act to pull the edge(s) of the sample away from each other as the sample is being compressed to assist it in being compressed without any folds or creases due to compressing alone. However, care must be taken to not excessively pull (i.e., and thus artificially stretch the sample) beyond what would be its natural extension through compression which is intended to temporarily remove the edge treatment for length measurement purposes here. The length of the Edge sample when finally compressed is determined by measuring the distance between the two dots first placed on the sample, to the nearest millimeter, and this is the Edge length value. The length of the Main sample is found using the same steps as for the Edge sample, but likely without the need to manually extend the sample during compression. The length of the Main sample when finally compressed is determined by measuring the distance between the two dots first placed on the sample, to the nearest millimeter, and this is the Main length value. The length of the samples are all determined in the same MD or CD of the wipe, depending on the desired MD or CD length value being evaluated. Ten samples (i.e., one sample of each portion from each of ten different wipes) are tested in this manner. The Edge length value for each sample is added together and the collective edge length value divided by ten, which thereby determines the Edge Length Value of the edge portion, which is discussed herein and set forth in the claims. The Main length value for each sample is added together and the collective main length value divided by ten, which thereby determines the Main Length Value of the main portion, which is discussed herein and set forth in the claims.

All publications, patents, and patent documents cited in the specification are incorporated by reference herein, as though individually incorporated by reference. In the case of any inconsistencies, the present disclosure, including any definitions herein, will prevail. While the invention has been described in detail with respect to the specific aspects thereof, it will be appreciated that those skilled in the art, upon attaining an understanding of the foregoing, may readily conceive of alterations to, variations of, and equivalents to these aspects which fall within the spirit and scope of the present invention, which should be assessed accordingly to that of the appended claims.

What is claimed is:

1. A plurality of wipes, each wipe comprising:

at least one non-woven web;

the web including an edge portion adjoining a main portion;

the web having a top surface and a spaced apart opposite bottom surface and defined by a width of the web which is perpendicular to a length of the web;

the top surface of the main portion defining a top plane and the bottom surface of the main portion defining a bottom plane, where the top and bottom planes are parallel to one another and where a z-directional dimension of the web extends through the top and bottom planes and is orthogonal to the top and bottom planes;

the edge portion including an edge treatment wherein the edge treatment comprises at least a portion of the edge portion being permanently deformed in a non-random pattern in the z-directional dimension such that the top surface of the edge portion defines a top edge plane and the bottom surface of the edge portion defines a bottom edge plane wherein at least one of the top edge plane and the bottom edge plane is outside of a bounded region defined between the top and bottom planes of the main portion; and each wipe is folded upon itself at least once and each wipe is positioned relative to adjacent wipes to form a stack of wipes.

2. The plurality of wipes of claim 1 wherein the stack of wipes is configured in a reach-in format to dispense each wipe from a wipes dispenser.

3. The plurality of wipes of claim 1 wherein each wipe in the plurality of wipes is discrete from each adjacent wipe.

4. The plurality of wipes of claim 1 wherein each wipe is folded such that the edge portion is located between opposite sides of the wipe when the wipe is folded upon itself.

5. A plurality of wipes, each comprising:

at least one non-woven web;

the web including an edge portion adjoining a main portion;

the web having a top surface and a spaced apart opposite bottom surface and defined by a width of the web which is perpendicular to a length of the web;

the top surface of the main portion defining a top plane and the bottom surface of the main portion defining a bottom plane, where the top and bottom planes are parallel to one another and where a z-directional dimension of the web extends through the top and bottom planes and is orthogonal to the top and bottom planes;

the edge portion including an edge treatment wherein the edge treatment comprises at least a portion of the edge portion being permanently deformed in a non-random pattern in the z-directional dimension such that the top surface of the edge portion defines a top edge plane and the bottom surface of the edge portion defines a bottom edge plane wherein at least one of the top edge plane and the bottom edge plane is outside of a bounded region defined between the to and bottom planes of the main portion and whereby the edge portion has an Edge Resilient Value and the main portion has a Main Resilient Value such that the Edge Resilient Value is greater than the Main Resilient Value; and each wipe is folded upon itself at least once and each wipe is positioned relative to adjacent wipes to form a stack of wipes.

6. The wipes of claim 5 wherein the Edge Resilient Value is at least 10% greater than the Main Resilient Value.

7. The wipes of claims 1, 5 or 6 wherein the edge portion including the edge treatment is a leading edge of the wipe.

8. The wipes of claims 1, 5 or 6 wherein the wipe comprises a wet wipe.

9. The stack of wipes of claims 1, 5 or 6 wherein each wipe of the plurality of wipes is formed from a portion of a common material.

10. The wipes of claims 1, 5 or 6 wherein the non-woven web comprises a composite elastic material.

11. The wipes of claims 1, 5 or 6 wherein the edge treatment extends along substantially an entire length of the edge portion.

12. The wipes of claims 1, 5 or 6 wherein the wipe has at least a second edge portion distinct from the edge portion and the second edge portion includes the edge treatment along at least a portion of the second edge portion.

13. The wipes of claims 1, 5 or 6 wherein the wipe comprises a visual differentiation cue such that at least a bottom surface of the edge portion or a top surface of the edge portion is visually differentiated from the main portion of the wipe when the wipe is folded upon itself.

14. The wipes of claim 13 wherein the visual differentiation cue comprises at least the edge portion having a pattern or a color or both a pattern and a color applied to at least the leading edge portion and not applied to at least a portion of the main portion.

15. A process for forming the wipes of claims 1, 5 or 6 into the stack of wipes comprising:

(a) providing a supply of a common material;

(b) forming a plurality of panels, each panel adjacent to at least one other panel;

(c) creating the edge treatment located along at least one side of each panel;

(d) converting the plurality of panels into a plurality of wipes, each wipe of the plurality of wipes including a leading edge portion with the edge treatment located along at least a portion of the leading edge portion and the edge treatment being distinct from an adjoining main portion of each wipe; and folding at least once each wipe of the plurality of wipes; and (e) positioning each wipe relative to adjacent wipes to form the stack of wipes.

16. The process of claim 15 wherein creating comprises creating the edge treatment in a machine direction of the plurality of panels.

17. The process of claim 15 wherein converting comprises wetting the plurality of panels to form a stack of wet wipes.

18. The process of claim 15 wherein forming comprises separating the panels from one another intermediate the edge treatment so as to create the edge treatment along each side of the panels.

19. The wipes of claim 5 wherein the Edge Resilient Value is at least 20% greater than the Main Resilient Value.

20. The wipes of claim 5 wherein the Edge Resilient Value is at least 30% greater than the Main Resilient Value.

21. The wipes of claim 5 wherein the Edge Resilient Value is at least 50% greater than the Main Resilient Value.

22. A plurality of wipes, each wipe comprising:

at least one non-woven web;

the web including an edge portion adjoining a main portion;

the web having a top surface and a spaced apart opposite bottom surface and defined by a width of the web which is perpendicular to a length of the web;

the top surface of the main portion defining a top plane and the bottom surface of the main portion defining a bottom plane, where the top and bottom planes are parallel to one another and where a z-directional dimension of the web extends through the top and bottom planes and is orthogonal to the top and bottom planes;

the edge portion including an edge treatment wherein the edge treatment comprises at least a portion of the edge portion being permanently deformed in a non-random pattern in the z-directional dimension such that the top surface of the edge portion defines a top edge plane and the bottom surface of the edge portion defines a bottom edge plane wherein at least one of the top edge plane and the bottom edge plane is outside of a bounded region defined between the top and bottom planes of the main portion; and whereby the edge portion has an Edge Length Value and the main portion has a Main Length Value such that the Edge Length Value is greater than the Main Length Value; and each wipe is folded upon itself at least once and each wipe is positioned relative to adjacent wipes to form a stack of wipes.

23. The wipes of claim 22 wherein the Edge Length Value is at least 5% greater than the Main Length Value.

24. The wipes of claim 22 wherein the Edge Length Value is at least 15% greater than the Main Length Value.

25. The wipes of claim 22 wherein the Edge Length Value is at least 25% greater than the Main Length Value.

26. The wipes of claim 22 wherein the Length Value is determined in the CD of the wipe and the Edge Length Value is at least 5% greater than the Main Length Value.

27. The wipes of claim 22 wherein the Length Value is determined in the CD of the wipe and the Edge Length Value is at least 10% greater than the Main Length Value.

* * * * *